United States Patent [19]

Grenzer

[11] Patent Number: 4,641,874

[45] Date of Patent: Feb. 10, 1987

[54] PORTAGING DEVICE

[76] Inventor: Leslie J. Grenzer, 7450 Indian Trail, Rockford, Minn. 55373

[21] Appl. No.: 594,763

[22] Filed: Mar. 29, 1984

[51] Int. Cl.[4] ..... A45F 3/15; B65G 7/12

[52] U.S. Cl. ..... 294/15; 114/343; 114/347; 224/268; 294/168

[58] Field of Search ..... 294/1 R, 15–17, 294/19 R, 92, 137, 141, 142, 153, 165, 167, 168; 114/343, 347; 224/252, 255, 262, 268–271, 191; 280/47.13 B

[56] References Cited

U.S. PATENT DOCUMENTS

| | | | |
|---|---|---|---|
| 452,950 | 5/1891 | Reese | 294/15 |
| 1,689,051 | 10/1928 | Richardson et al. | 224/268 X |
| 1,721,745 | 7/1929 | Otto | 294/15 |
| 2,391,928 | 1/1946 | Seib | 294/15 X |
| 2,416,016 | 2/1947 | McKenna | 294/15 |
| 2,651,441 | 9/1953 | Rau et al. | 224/268 X |
| 3,101,203 | 8/1963 | Raymond | 280/47.13 B X |
| 3,375,960 | 4/1968 | Stevens et al. | 224/191 X |
| 3,377,095 | 4/1968 | Allen | 294/19 R |
| 3,436,778 | 4/1969 | Stevens et al. | 294/15 X |
| 3,734,367 | 5/1973 | Jackson | 224/262 |

FOREIGN PATENT DOCUMENTS

| | | | |
|---|---|---|---|
| 1000713 | 8/1965 | United Kingdom | 294/16 |

*Primary Examiner*—Johnny D. Cherry
*Attorney, Agent, or Firm*—Alan G. Greenberg

[57] ABSTRACT

This disclosure relates to a removable portage handle for canoes. A first transverse member is removably secured to the bow/stern of the canoe by adjustable clamps. The handle member is pivotably secured to the first transverse member. A second transverse member is secured to the handle member and removably secured to the canoe. The handle member is adapted to be generally horizontal by including an obtuse angle. The obtuse angle is reinforced as by a truss. Further weight transfer is provided for in the form of a hook member secured to a belt which may be worn by a canoeist on the shoulder, around the waist, or both. The hook member is adapted to mate with and engage a hook receptacle secured to the handle member.

1 Claim, 4 Drawing Figures

PORTAGING DEVICE

This invention relates to a means for easily transporting or portaging with canoes or other relatively light boats.

In the art, there are shown various devices for portaging with a canoe. These generally take the form of a strap or handle which allows the canoe to be carried upside down more comfortably.

Oftentimes, it is desireable to carry a canoe right side up so that camping gear, food and other supplies may be readily carried in the canoe so as to avoid multiple trips. When carrying the canoe upright, one is struck by the lack of places on the canoe on which a good, secure and comfortable grip may be had.

Consequently, it is one of the purposes of this disclosure to provide a handle which will readily adapt to a wide range of canoes and which provides a comfortable, secure way to carry the canoe in an upright position.

Referring now to the drawings.

Figure 1:
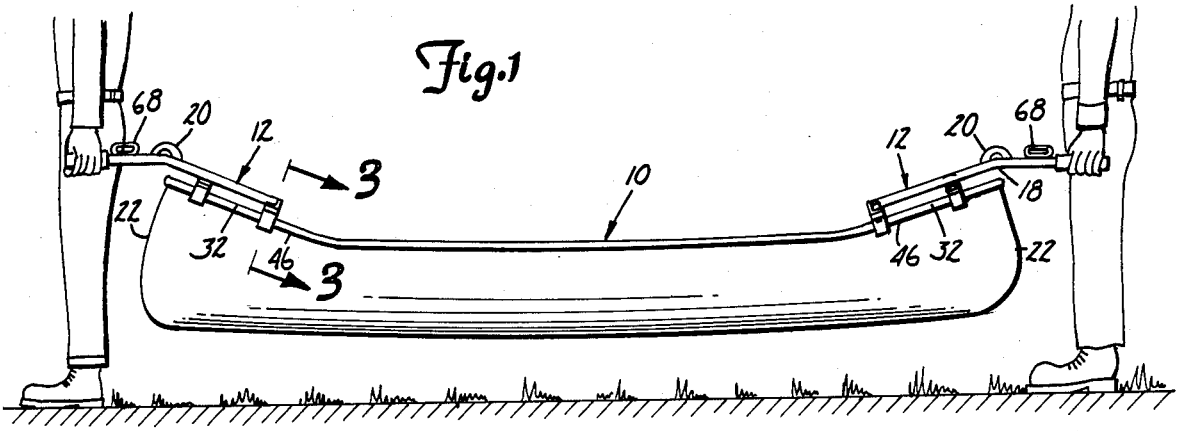
FIG. 1 is a pictorial view depicting a canoe with the handles of this teaching attached and being carried by two canoeists.

A canoe 10 is shown with portaging device 12 according to this teaching in place.

Portaging device 12 is comprised of a handle member 14. Handle member 14 is suitably shown with a soft handgrip 16 to enhance the comfort of a person carrying the canoe 10. To further enhance the comfort and ability to carry canoe 10, means are provided to have handle member 14 generally horizontal at the point of handgrip 16. This is suitably accomplished by providing handle member 14 with an obtuse angle or bend 18, with the vertex of the obtuse angle at the point of the bow/stern 22. Bend 18 would form a weak spot in handle member 12; consequently, a reinforcing means is provided and is shown here as truss 20.

Figure 2:
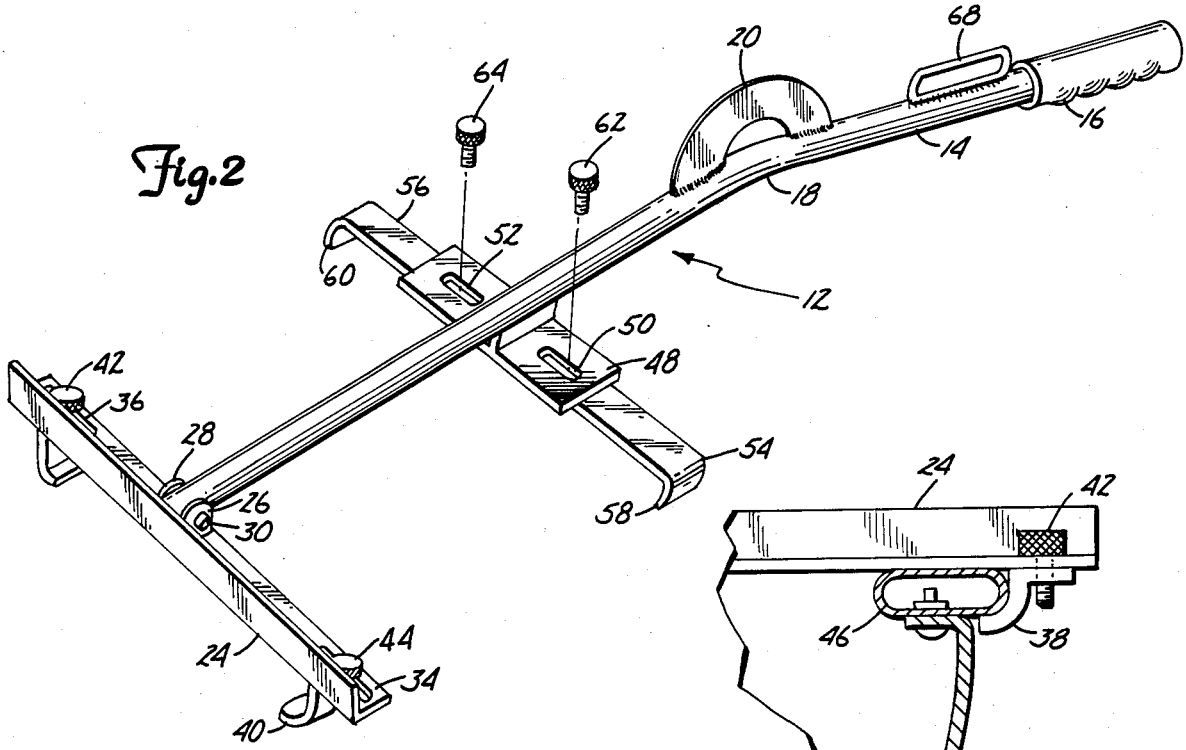
FIG. 2 is an enlarged pictorial view of the carrying handle device.
Figure 3:
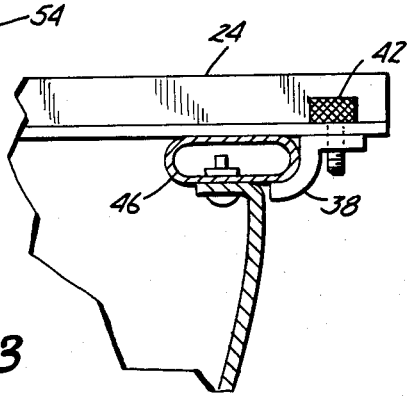
FIG. 3 is a partial section in the direction of arrow 3—3 in FIG. 1 showing the handle unit as secured to a canoe; and, FIG. 4 is a pictorial view depicting the carrying belt attachment.
Figure 4:
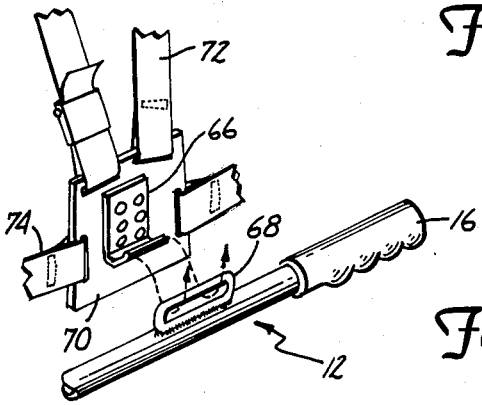

Means for removably securing said handle member 12 to the bow/stern 22 of canoe 10 is provided. Such means is depicted by at least one member transversely, adjustably secured to handle member 12. In the preferred form of this invention, two transverse members are provided. One transverse member is shown as an angle structural member 24. Angle structural member 24 is provided with a means for pivotably securing handle member 12 as is shown in FIG. 2 by flanges 26 and 28 rigidly secured to angle structural member 24. A pivot is provided to pivotably secure handle member 12 to angle structural member 24 as shown by a transverse pin or bolt 30 transversely through flanges 26 and 28 and handle member 14. By pivotably securing handle member 12 to angle structural member 24, it will be appreciated that the portaging device 12 may be employed with a range of decks 32 of canoes 10 having different angles.

Because canoes 10 are constructed by various manufacturers, with various angles of decks 32 and varying bow and stern angles and widths of the bow and stern 22, provision is made for adjustably securing angle structural member 24 to canoe 10. One suitable means is shown by providing slots 34 and 36 in angle structural member 24. Clamps 38 and 40 are adjustably secured to angle structural member 24 by screws 42 and 44. Clamp 38 is adapted to engage and grip gunwale 46 of canoe 10. As screws 42 and 44 are tightened, clamps 38 and 40 hold angle structural member 24 securely to canoe 10.

To provide better stability and support for handle member 12, a second transverse member is employed. This is shown constructed of plate 48 and clamping bars 54 and 56. Plate 48 is provided with slots 50 and 52 to provide transverse adjustment. Clamping bars 54 and 56 are provided to adapt to a wide range of bow/stern 22 widths. Also by providing separate clamping bars 54 and 56 rather than a rigid one-piece member, bars 54 and 56 may be adjusted to be generally perpendicular to gunwale 46 for best engagement of clamps 58 and 60 with gunwale 46. Clamping bars 54 and 56 may be secured by inserting and tightening screws 62 and 64.

Yet another means for lightening the burden of the portager is provided by a weight transfer means. Such a means is suitably shown by a hook member 66. Said hook member 66 is adapted to engage and be releaseably secured to a cooperating mating member such as hook receptacle 68 on handle member 12. Hook member 66 is shown secured to a mounting such as heavy leather plate 70. Leather plate 70 may be secured either to a shoulder belt 72 or waist belt 74 or both. The belts 72 and 74 are worn by a portager and take much of the weight of the canoe 10 and its load.

It is obvious that many design changes can be made to this disclosure without departing from the teaching herein and thus, the scope of this invention should be limited only by the claims.

I claim:

1. A canoe portaging device comprising: at least one handle adapted to be removably secured to the bow or stern of a canoe, said handle being removably secured to the canoe by securing at least two transverse members removably, transversely secured to said handle and clamping means adjustably secured to each end of said transverse members and adapted to selectively engage the gunwale of the canoe, said handle being further adapted to remain approximately horizontal and independent of the angle of the bow or stern of the canoe by providing said handle with an obtuse angle and a reinforcement means for strengthening said angle; and a weight transfer means comprised of a belt adapted to be worn by the canoeist and a mating member secured to said handle and adapted to releaseably mate with said belt.

* * * * *